US006699075B1

(12) United States Patent
Ko

(10) Patent No.: US 6,699,075 B1
(45) Date of Patent: Mar. 2, 2004

(54) HIGH-SPEED LOW PROFILE CABLE ASSEMBLY WITH IMPROVED EMI SHIELDING

(75) Inventor: David (Tso-Chin) Ko, Fullerton, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/431,148

(22) Filed: May 6, 2003

(51) Int. Cl.[7] ..... H01R 13/658
(52) U.S. Cl. ..... 439/610; 439/98; 439/939
(58) Field of Search ..... 439/607–610, 439/92, 95, 181, 98, 939

(56) References Cited

U.S. PATENT DOCUMENTS 4,830,629 A * 5/1989 Yoshimura ..... 439/610
4,838,808 A * 6/1989 Fujiura ..... 439/357
6,045,390 A * 4/2000 Metz et al. ..... 439/405
6,506,075 B2 * 1/2003 Chiran et al. ..... 439/607

* cited by examiner

*Primary Examiner*—Tho D. Ta
*Assistant Examiner*—James R. Harvey
(74) *Attorney, Agent, or Firm*—Wei Te Chung

(57) ABSTRACT

A cable assembly (1) includes a multi-wire cable (10) and an electrical connector. The connector comprises an insulative housing (20) having a plurality of terminals (21) electrically connected with wires of the cable and a metallic shielding (30) attached to the housing. The shielding has a first portion (31) and a second portion (32) coupled with each other to form a space for accommodating the housing. The first portion has a locking portion (316) extending therefrom for securing the shielding to a EMI shielding in the cable, and the second portion has an opening (3242) formed at a middle portion of one side wall (324) thereof for leading the cable into the space and establishing electrical connection with terminals in the housing.

6 Claims, 6 Drawing Sheets

HIGH-SPEED LOW PROFILE CABLE ASSEMBLY WITH IMPROVED EMI SHIELDING

BACKGROUND OF THE INVENTION

1. Field of the Invention

The present invention relates to the art of electrical connector, more particularly, to a cable assembly having conductive wires extending through longitudinal side wall of a shielding of an electrical connector thereby providing a low profile, but EMI free environment to ensure signal transmission.

2. Description of the Related Art

A cable assembly is commonly used to interconnect two separate electrical systems and establish an electrical connection therebetween. The assembly typically includes a cable and two cable end connectors respectively connected to one end of the cable. The cable can be a coaxial cable, a flat cable, or a multi-wire cable. The cable can be electrically connected with terminals of the cable end connectors by several commonly used technologies, i.e., soldering, crimping, or IDC (Insulation Displacement Contact) technology.

With the popularization of portable electronic device, such as desktop computer and notebook computer, and with the development of high-speed signal transmission technology, the cable assembly used to transmit signals in such devices is also required to develop a minimized diameter for the cable as well as keeping a low profile figuration for the cable end connector, such that the assembly does not occupy too much space in the device. Meanwhile, when the cable assembly is used to transmit high-speed signal, the cable end connector is commonly required to attach a metallic shielding thereon to prevent EMI (Electro Magnetic Interference) from outer environments.

Actually, attaching an EMI shielding onto an insulative housing of a cable end connector has been widely utilized in the arts, the related prior arts are disclosed in U.S. Pat. Nos. 6,162,086 and 6,179,662, but these prior arts all have certain shortcomings which do not meet either the requirement of ensuring high-speed signal transmission or keeping low profile figuration of the connector.

U.S. Pat. No. 6,162,086 discloses a conventional cable assembly having an outer EMI shielding. The cable is arranged into the housing of the connector from a top wall of the connector, which leads to the whole height of the connector in a substrate rises when the connector is mounted to the substrate. Correspondingly, more space is occupied as a result of the higher configuration of the connector. If the connector is applied to an electronic device requiring a small dimension, it might not meet the requirement of low profile configuration.

U.S. Pat. No. 6,179,662 discloses another conventional cable assembly. Its improvement in comparison with what is disclosed in U.S. Pat. No. 6,162,086 is that the cable is arranged into the housing of the one of transverse end walls of the connector housing. Therefore, the whole height of the cable assembly is decreased. However, the cable assembly still has some disadvantages which influence signal transmission performance when the cable assembly is utilized to transmit high-speed signal. As described in the prior art, each terminal in the housing of the connector is connected with a corresponding signal wire of the cable, and the wire which is farthest to the end wall is longer than the wire which is nearest to the end wall. The length difference between the farthest and the nearest wires is substantially the longitudinal length of the connector. When the cable is applied to transmit a high speed signal, the apparent length difference of the signal wires impairs the synchronicity and accuracy of the signal transmission.

Therefore, it is necessary to develop an improved low profile cable assembly to overcome the above shortcomings.

SUMMARY OF THE INVENTION

An object of the present invention is to provide a cable assembly having an improved EMI shielding which has a minimized low-profile configuration as well as maintaining excellent EMI performance.

Another object of the present invention is to provide an metallic shielding for a low profile cable end connector, which can be easily assembled to the connector and can keep low-profile configuration of the connector.

To fulfill the above objects, a cable assembly in accordance with the present invention comprises a cable having a plurality of wires and two low profile cable end connector respectively connected with one end of the cable. The connector includes an insulative housing having a plurality of electrical terminals received therein. The housing has a mating surface adapted to mating with a mating connector. A metallic shielding is attached to the housing functioning as an EMI shielding. The shielding substantially surrounds the housing, and has a first opening in alignment with the mating surface of the housing and a second opening formed near a middle portion of one side wall of the shielding adapted to allow the wires of the cable to extend therethrough thereby establishing an electrical connection with the terminals in the housing. The wires of the cable are terminated to terminals of the connector by Insulation Displacement Contact (IDC) technology.

The shielding further has a locking portion extending outwardly from adjacent the second opening. The locking portion forms a latching end at a free end thereof for fastening to an EMI shielding of the cable thereby establishing an overall EMI protection throughout the cable assembly. The clamping portion can be a clasp or a crimping end.

Other objects, advantages and novel features of the present invention will become more apparent from the following detailed description when taken in conjunction with the accompanying drawings, in which:

DESCRIPTION OF THE PREFERRED EMBODIMENTS

Now one embodiment of the present invention will be illustrated in detail with reference to the above drawings.

Figure 1:
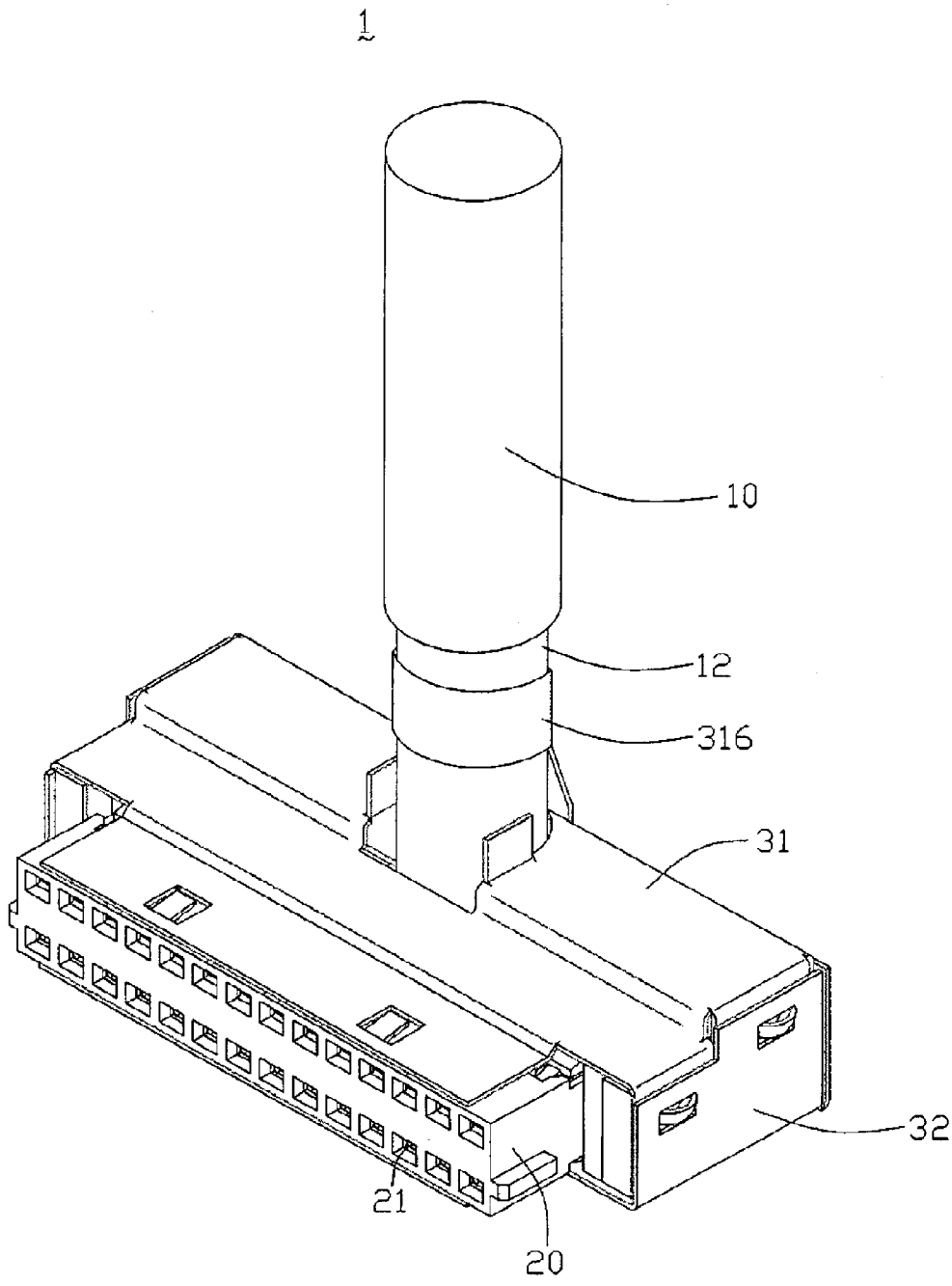
FIG. 1 is a perspective view of a cable assembly in accordance with a preferred embodiment of the present invention.
Figure 2:
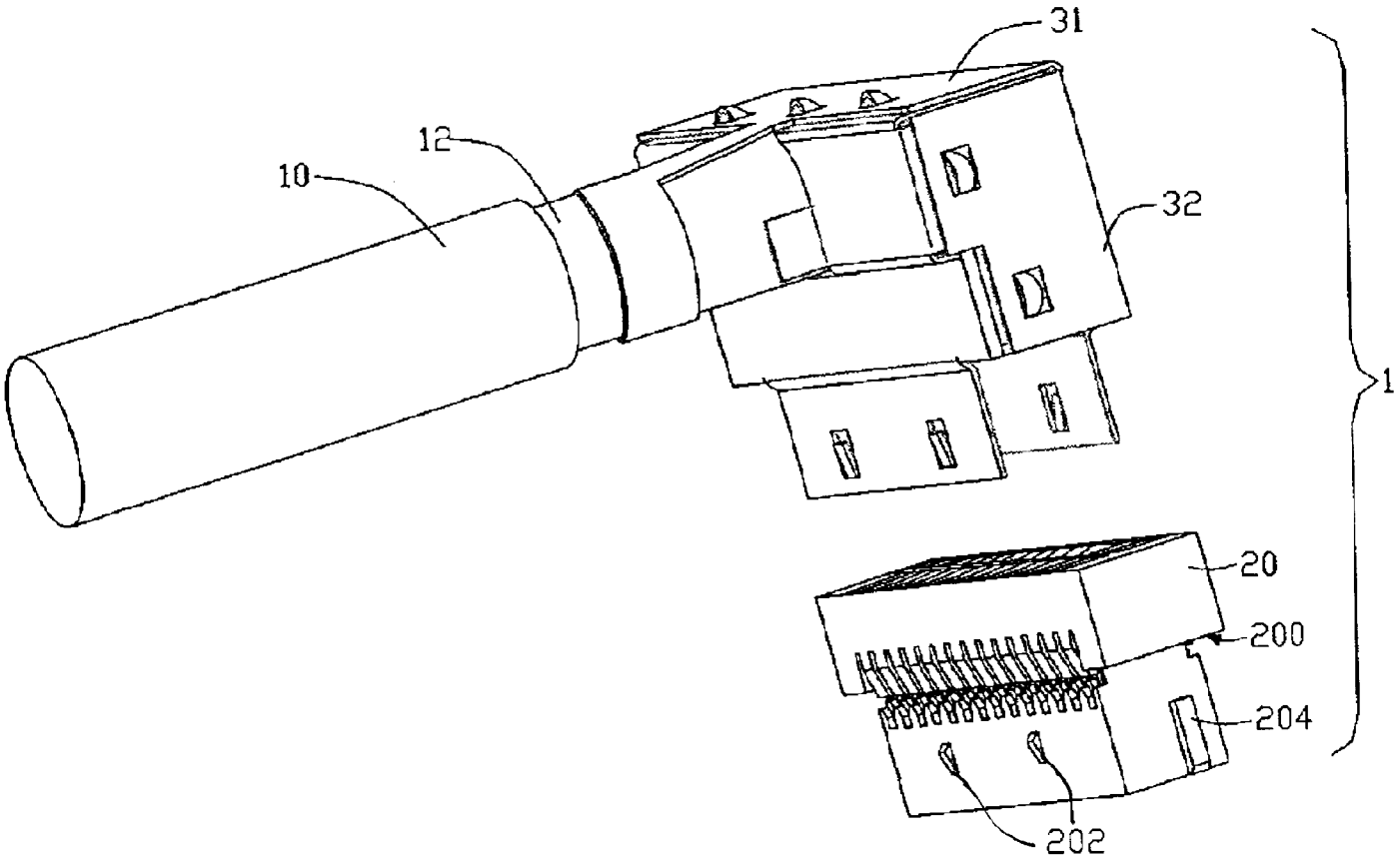
FIG. 2 is an exploded view of the connector assembly of FIG. 1.

Referring to FIGS. 1 and 2, a cable assembly 1 in accordance with a preferred embodiment of the present invention comprises a multi-wire cable 10, and a low profile cable end connector connected with the cable 10. The cable 10 includes a plurality of high-speed signal wires 13 surrounded by an EMI (Electro Magnetic Interference) shielding 12, and the shielding 12 is enclosed by an outer insulative jacket 10. The connector comprises an insulative housing 20 having a plurality of electrical terminals 21 received therein. Each terminal 21 is electrically connected with a corresponding wire 13 of the cable 10. In this embodiment, the terminal 21 is terminated to the wire 13 by Insulation Displacement Contact (IDC) Technology. Understandably, the terminal can also be connected to the wire by other technology, i.e., soldering the terminal to the wire. The terminal 21 has a mating portion extending toward a mating surface 200 of the housing 20 for mating with a mating connector (not shown in the FIGURES). The connector further comprises a metallic shielding 30 covering the housing 20 functioning as an anti-EMI device to protect the signal transmission between the cable 10 and the connector from being interfered by EMI from outer environments. Structure of the shielding 30 is illustrated in detail as follows with reference to the FIGURES. A pair of keys 204 are formed on two ends of the housing 20 for compliantly mating with keyways of the complementary connector.

Figure 3:
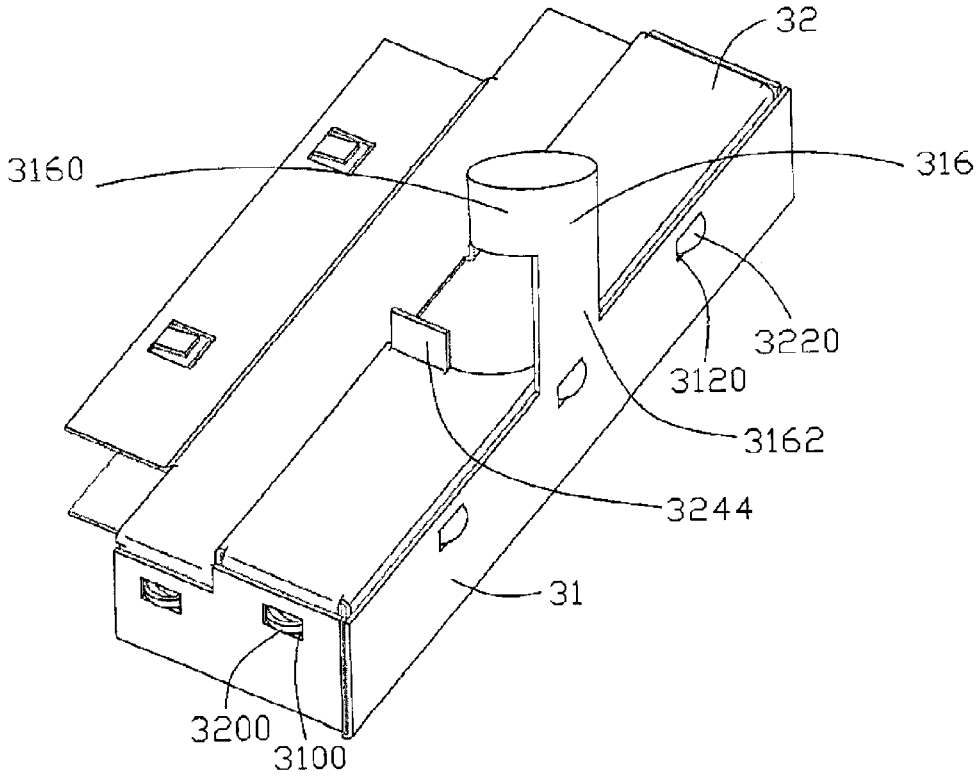
FIG. 3 is a perspective view of the metallic shielding of FIG. 2.
Figure 4:
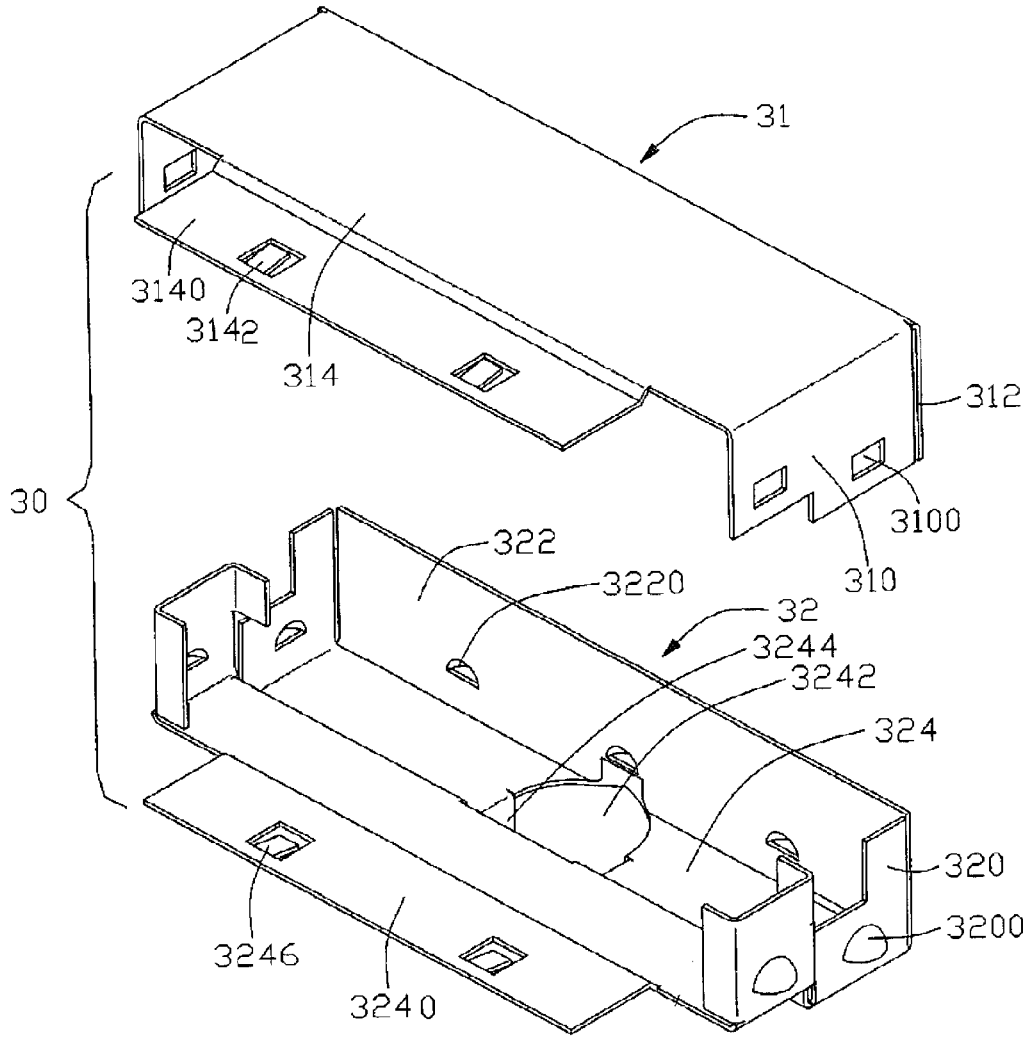
FIG. 4 is an exploded view of the metallic shielding of FIG. 3.
Figure 5:
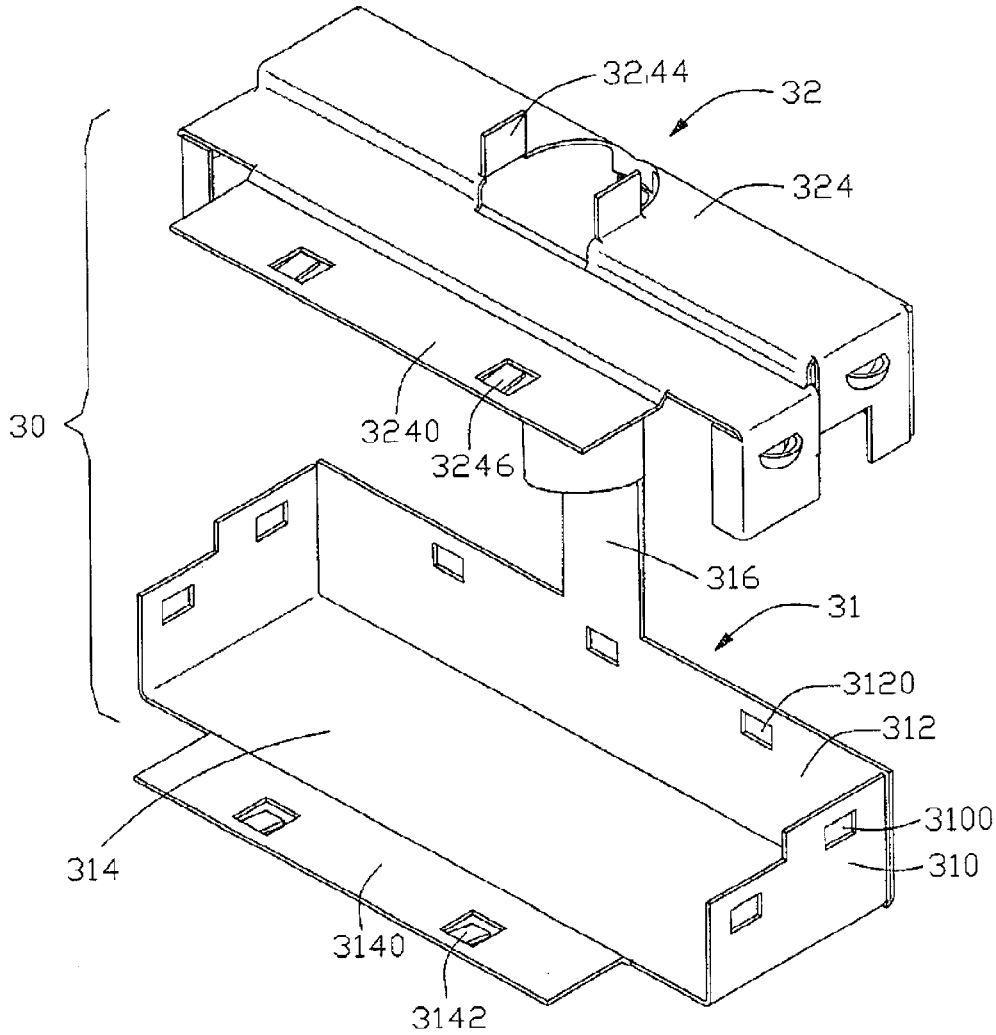
FIG. 5 is another exploded view of the metallic shielding of FIG. 3, seen other angel of view.

Referring to FIGS. 3, 4 and 5, the shielding 30, which is formed by stamping and bending a sheet of metal, includes a first portion 31, or calling a lower portion 31, and a second portion 32 coupled with the first portion 31, or calling an upper portion 32.

The first portion 31 has two opposite end walls 310, a top wall 312, and a side wall 314 interconnecting the end walls 310. The end walls 310 and the top wall 312 all have a plurality of recesses 3100 and 3120 formed thereof. The side wall 314 has a first tongue portion 3140 extending downwardly therefrom, and the tongue portion 3140 has two first notches 3142 disposed thereof. Function of the recess 3100, 3120 and the notches 3142 will be described later.

The second portion 32 has two opposite end walls 320, a top wall 322, and a side wall 324 interconnecting the end walls 320. The end walls 320 and the top wall 322 respectively have a plurality of tabs 3200 and 3220 formed thereof. The side wall 324 has a second tongue portion 3240 extending downwardly therefrom, the tongue portion 3240 has two second notches 3242 disposed thereof.

When the first and second portions 31 and 32 are assembled together, the end walls 310 of the first portion 31 mates with the end walls 320 of the second portion 32 by arranging the tabs 3200 into the recesses 3100, and the top wall 312 of the first portion 31 couples with the top wall 322 of the second portion 32 by pressing the tabs 3220 into the recesses 3120. The first and second notches 3142, 3246 formed in the tongue portions 3140, 3240 respectively engages tabs 202 projected from side walls of the housing 20 after the first and second portions 31 and 32 are assembled onto the housing 20. Therefore, the first and second portions 31 and 32 couple with each other to form a receiving space therebetween for receiving the housing 20 therein, and the space has a first opening in alignment with the mating surface of the housing 20.

The first portion 31 further includes a locking portion 316 extending from the top wall 312, the extending direction of the locking portion 316 is substantially parallel to the top wall 312, which is connected with the top wall 321 through a connecting portion 3162. A clasp 3160 is formed at a free end of the locking portion 316. In the embodiment, the clasp 3160 is a close circular structure which has a diameter substantially the same as that of the cable 10. Correspondingly, the second portion 32 has an opening 3242 (the second opening) integrally formed at a middle portion of the side wall 324, the dimension of the opening 3242 is fit to accommodate the cable 10 to extend through the opening 3242. A pair of grounding tab 3244 is formed adjacent to the opening 3242 and extends along the extending direction of the locking portion 316. Referring to FIG. 3 again, after the first and second portions 31 and 32 are assembled together, the locking portion 316 does not extend beyond the top walls 312 and 322, and the two grounding tabs 3244 are located between the side wall 324 and the clasp 3160. In the embodiment, the connecting portion 3162 of the locking portion 316 is located above the opening 3242 and does not extend through the opening 3242, understandably, the connecting portion 3262 can also be adjusted to extend throughout the side wall 324 from the opening 3242.

Process of assembling the cable assembly 1 follows the following steps. Firstly, one end of the cable 10, with outer jacket 11 being removed and the wires therein being exposed, extends in turn through the clasp 3160 and the opening 3242 (the second opening) and into the space surrounded by the first and second portions 31 and 32 of the shielding 30. Secondly, the housing 20 is assembled into the space from the first opening with the terminals therein being electrically connected with wires 13 of the cable 10. Thirdly, the first and second portions 31 and 32 are coupled with each other by engagement between the tab 3200(3220) and the recess 3100 (3120), and secure the housing 20 in the shielding via engagement between the notch 3142(3246) and the tab 202. Finally, the grounding tabs 3244 are soldered to the EMI shielding 13 of the cable, such that the cable assembly forms an overall EMI shielding throughout the cable end connector and the cable 10.

Figure 6:
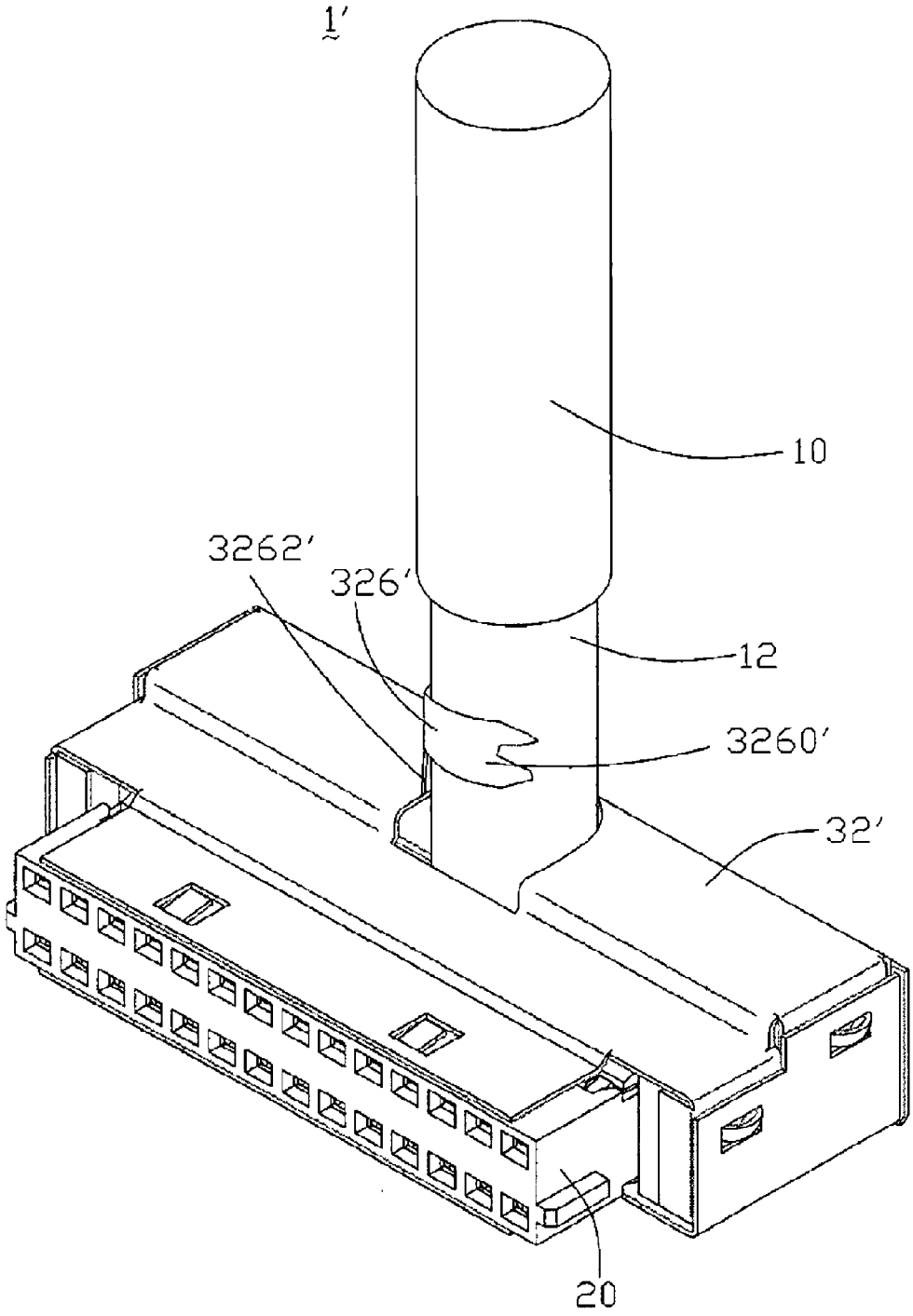
FIG. 6 is a perspective view of a cable assembly in accordance with a embodiment of the present invention.

FIGS. 6 show a second embodiment of the cable assembly of the present invention, which has a similar structure as the preferred embodiment. What is different therebetween is that a locking portion 326' is formed on side wall 324' of the second portion 32'. The locking portion 326' is located near one side of opening 3242', which has a connecting portion 3262' connected with the side wall 324' and a crimping end 3260' formed at a free end thereof. The connecting portion 3262' also functions as a grounding tab. The two crimping ends 3260' of the locking portions 326' mate with each other to crimp the EMI shielding 12 of the cable 11.

From the above description, It is understood that the cable assembly of the present invention provides several features that overcome shortcomings appeared in the prior arts. The second opening of the shielding is located and dimensioned in such a way that the cable is led into the connector from a middle portion of one side wall of the shielding in a direction perpendicular to the mating direction of the connector such that the whole height of the cable assembly is minimized. Furthermore, the cable extends into the connector from a middle portion of the side wall of the shielding such that the wires in the housing is substantially symmetrical with respect to the cable such that the wires of the cable can be terminated to terminals in the housing in a symmetrical manner. Additionally, the shielding of the connector has a locking portion which can not only secured the shield to cable, but also electrically connected with the EMI shielding of the cable thereby establishing an overall EMI shielding throughout the cable assembly.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable assembly, comprising:

a cable having a plurality of wires;

a low profile connector including:

an insulative housing having a plurality of electrical terminals received therein, the housing having a mating surface adapted to mating with a mating component;

a metallic shielding attached to the housing having a first opening in alignment with the mating surface of the housing; and wherein the cable extending through longitudinal sidewall of the shielding thereby establishing electrical connection between the wires and the terminals in the housing;

wherein a second opening is formed substantially at a middle portion of one side wall of the shielding, the second opening is dimensioned to allow the cable to extend therethrough;

wherein the cable comprises an outer jacket and an EMI shielding settled between the jacket and the wires;

wherein the shielding comprises a first portion and a second portion coupled with the first portion, the first opening is surrounded by end walls and side walls of the first and second portions:

wherein a plurality of recesses are formed in the walls of the first portion, and a plurality of tabs are formed in the walls of the second portion in alignment with and engaging into the recesses of the first portion;

wherein the tabs are semi-spherical shaped tabs;

wherein the cable extends through the second opening in a direction that is perpendicular to the mating direction of the connector.

2. The cable assembly as claimed in claim 1, wherein the second opening is formed in the side wall of the second portion.

3. The cable assembly as claimed in claim 2, wherein a grounding tab is formed adjacent to the second opening and extends toward the cable for being connected to an EMI shielding of the cable.

4. The cable assembly as claimed in claim 1, wherein the shielding further includes a locking portion formed adjacent the second opening adapted to secure the shielding to the EMI shielding of the cable.

5. The cable assembly as claimed in claim 4, wherein the locking portion extends from a top wall of the first portion of the shield and comprises a clasp formed at a free end thereof for crimping the EMI shielding of the cable.

6. The cable assembly as claimed in claim 4, wherein the locking portion extends from the side wall of the second portion of the shielding adjacent the second opening.

* * * * *